US007267569B2

(12) United States Patent
Nakamura

(10) Patent No.: US 7,267,569 B2
(45) Date of Patent: Sep. 11, 2007

(54) CONNECTOR WITH A SHORTING TERMINAL

(75) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/498,338

(22) Filed: Aug. 3, 2006

(65) Prior Publication Data

US 2007/0054537 A1 Mar. 8, 2007

(30) Foreign Application Priority Data

Aug. 17, 2005 (JP) ..... 2005-236592

(51) Int. Cl.
*H01R 13/627* (2006.01)

(52) U.S. Cl. ..... 439/353

(58) Field of Classification Search ..... 439/353, 439/350, 352, 620, 188, 686, 625, 355, 357–358, 439/752, 372, 489, 942
See application file for complete search history.

(56) References Cited

U.S. PATENT DOCUMENTS 5,314,345 A 5/1994 Cahaly et al.
6,217,388 B1 * 4/2001 Francis ..... 439/620.07
6,257,910 B1 * 7/2001 Mramor ..... 439/188
6,899,556 B2 * 5/2005 Nishida et al. ..... 439/188
6,945,801 B2 * 9/2005 Brown ..... 439/188
7,108,539 B2 * 9/2006 Gunreben et al. ..... 439/352
2002/0137397 A1 * 9/2002 Little ..... 439/686

* cited by examiner

*Primary Examiner*—J. F. Duverne
(74) *Attorney, Agent, or Firm*—Gerald E. Hespos; Anthony J. Casella

(57) ABSTRACT

A first housing (10) is formed with guiding holes (24) through which a releasing member (27) is inserted while being held in contact therewith in a movable range between a standby area and a releasing position. In the process of connecting the first housing (10) and a second housing (40), the releasing member (27) comes into engagement with the second housing (40), thereby being displaced backward relative to the first housing (10). Since the first housing (10) is formed with the guiding holes (24) through which the releasing member (27) is inserted while being held in contact therewith, the releasing member (27) is smoothly moved without being displaced and being forced.

19 Claims, 12 Drawing Sheets

CONNECTOR WITH A SHORTING TERMINAL

BACKGROUND OF THE INVENTION

1. Field of the Invention

The invention relates to a connector with a shorting terminal.

2. Description of the Related Art

U.S. Pat. No. 5,314,345 discloses a connector with first and second housings. A releasing member is provided in the first housing and is movable between a releasing position and a standby area located behind the releasing position. A shorting terminal is provided in the second housing for shorting terminal fittings. A resilient piece is provided in the first housing and engages a locking piece on the releasing member to hold the releasing member in the standby area when the housings are not yet connected. The releasing member is still in the standby area when the two housings are partly connected. However, the releasing member is moved to the releasing position to deform the shorting terminal and to release a shorted state of the terminal fittings when the two housings connected properly. Thus, movement of the releasing member to the releasing position indicates that the two housings have reached a properly connected state.

The releasing member may not move smoothly to the releasing position if the releasing member is displaced relative to the housing or if the releasing member and the housing are brought forcibly into contact. In such a case, an operator may mistakenly conclude that the housings are connected properly despite the partly connected state thereof and may leave the housings only partly connected.

The invention was developed in view of the above problem, and an object thereof is to enable a releasing member to be moved smoothly.

SUMMARY OF THE INVENTION

The invention relates to a connector that comprises first and second housings that are connectable with one another. A shorting terminal is mounted to the second housing for shorting terminal fittings. A releasing member is mounted to the first housing and is movable between a releasing position and a standby area spaced from the releasing position. The first housing engages the releasing member and holds the releasing member at the standby area when the housings are not yet connected. However, the releasing member is moved to the releasing position to deform the shorting terminal and to release a shorted state of the terminal fittings when the housings are connected properly. The first housing has at least one guiding hole, and the releasing member is guided slidably through the guiding hole in a movable range between the standby area and the releasing position as the housings are being connected. The releasing member can engage the second housing to be displaced backward relative to the first housing. The guiding hole guides the releasing member smoothly without being displaced or forced.

The releasing member preferably is operable in a direction substantially parallel to the connecting direction of the housings.

At least one unlocking piece preferably is inserted in the guiding hole when the releasing member is at a standby position in the standby area on the first housing to prevent the releasing member from being displaced at an angle to a moving direction of the releasing member relative to the housing.

The releasing member can be moved back relative to the first housing. However, the releasing member preferably has at least first and second locks that are engageable with at least one window of the first housing so that the resilient member does not come back out of the first housing.

A resilient piece preferably is provided on the first housing and engages a locking piece on the releasing member to hold the releasing member in a standby area when the housings are not yet connected.

The releasing member preferably engages the second housing in the process of connecting the housings and resiliently deforms while the locking piece is not in contact with the second housing to release the interlocked state of the resilient piece and the locking piece.

The resilient piece and the locking piece preferably can deform at an angle to interlocking directions of the resilient piece and the locking piece.

The guiding hole preferably is substantially flat and wide.

The rear surface of the releasing member preferably is substantially flush with the corresponding surface of the housing when the releasing member is in the releasing position.

The invention also relates to a connector assembly comprising the above-described connector and a mating connector connectable therewith. The mating connector comprises the mating housing with the shorting terminal for shorting terminal fittings.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
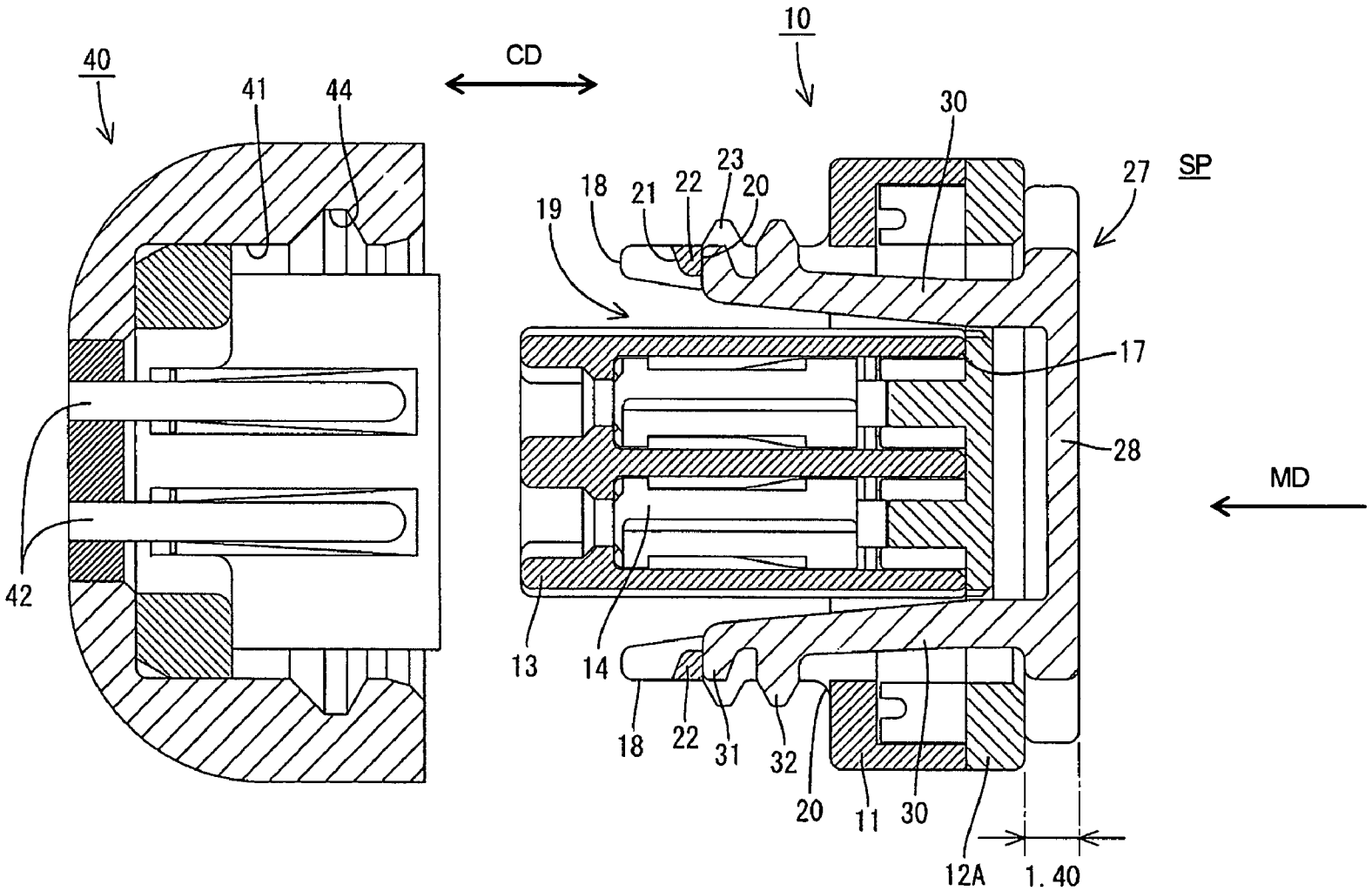
FIG. 1 is a horizontal section showing a state before a first housing and a second housing according to one preferred embodiment are connected.

A connector assembly in accordance with the invention includes first and second housings that are identified respectively by the numerals 10 and 40 in FIGS. 1 to 13. Mating-ends of the first and second housings 10, 40 are referred to herein as the front.

The first housing 10 includes a main body 11 made e.g. of a synthetic resin, and covers 12A, 12B are mountable on the main body 11. A connecting projection 13 projects forward from the upper part of the main body 11, and left and right female terminal fittings 14 are accommodated into the connecting projection 13 from behind. Wire connecting portions 15 extend down at substantially right angles from the rear ends of the female terminal fittings 14 and are connected respectively with wires 16. The female terminal fittings 14 are covered by the covers 12A, 12B mounted on the rear surface of the main body 11. The rear surface of the upper cover 12A is recessed slightly to form an accommodating recess 17.

Left and right resilient pieces 18 cantilever forward from the upper part of the main body 11 at the opposite left and right sides of the connecting projection 13 and deformation spaces 19 are defined between the resilient pieces 18 and the connecting projection 13. The resilient pieces 18 are resiliently deformable in transverse directions towards and away from the connecting projection 13 and substantially normal to a connecting direction CD of the two housings 10, 40 with the rear ends of the resilient pieces 18 as supports. A window 20 penetrates each resilient piece 18 at a position near the supporting point of resilient deformation and a notch 21 is formed at the front end of each resilient piece 18 before the window 20. A restricting portion 22 is defined on the resilient piece 18 between the window 20 and the notch 21, and a disengaging portion 23 projects out from the outer surface of the resilient piece 18 at a position closer to the rear end than the restricting portion 22.

Figure 2:
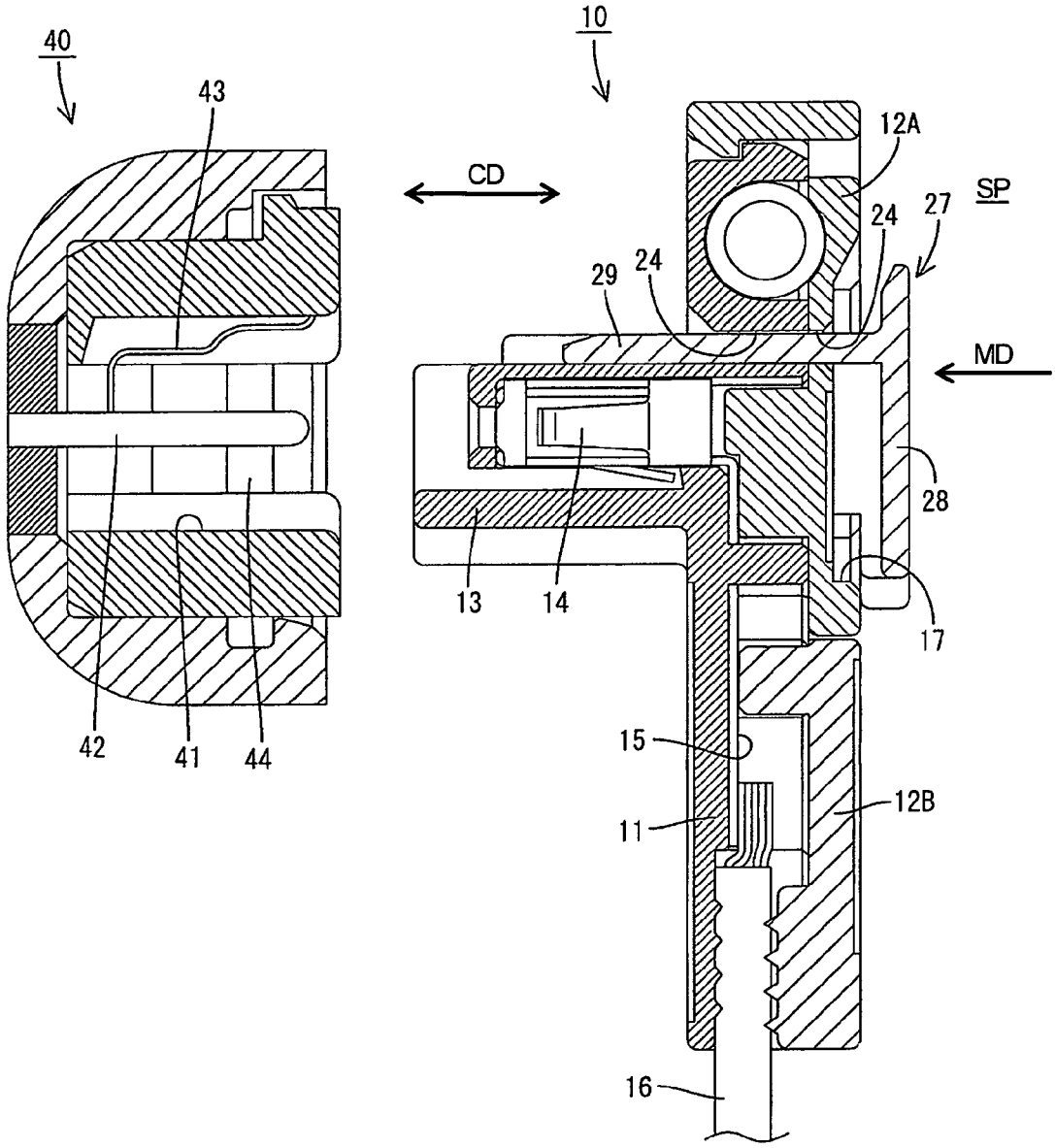
FIG. 2 is a vertical section showing the state before the first and second housings are connected.
Figure 10:
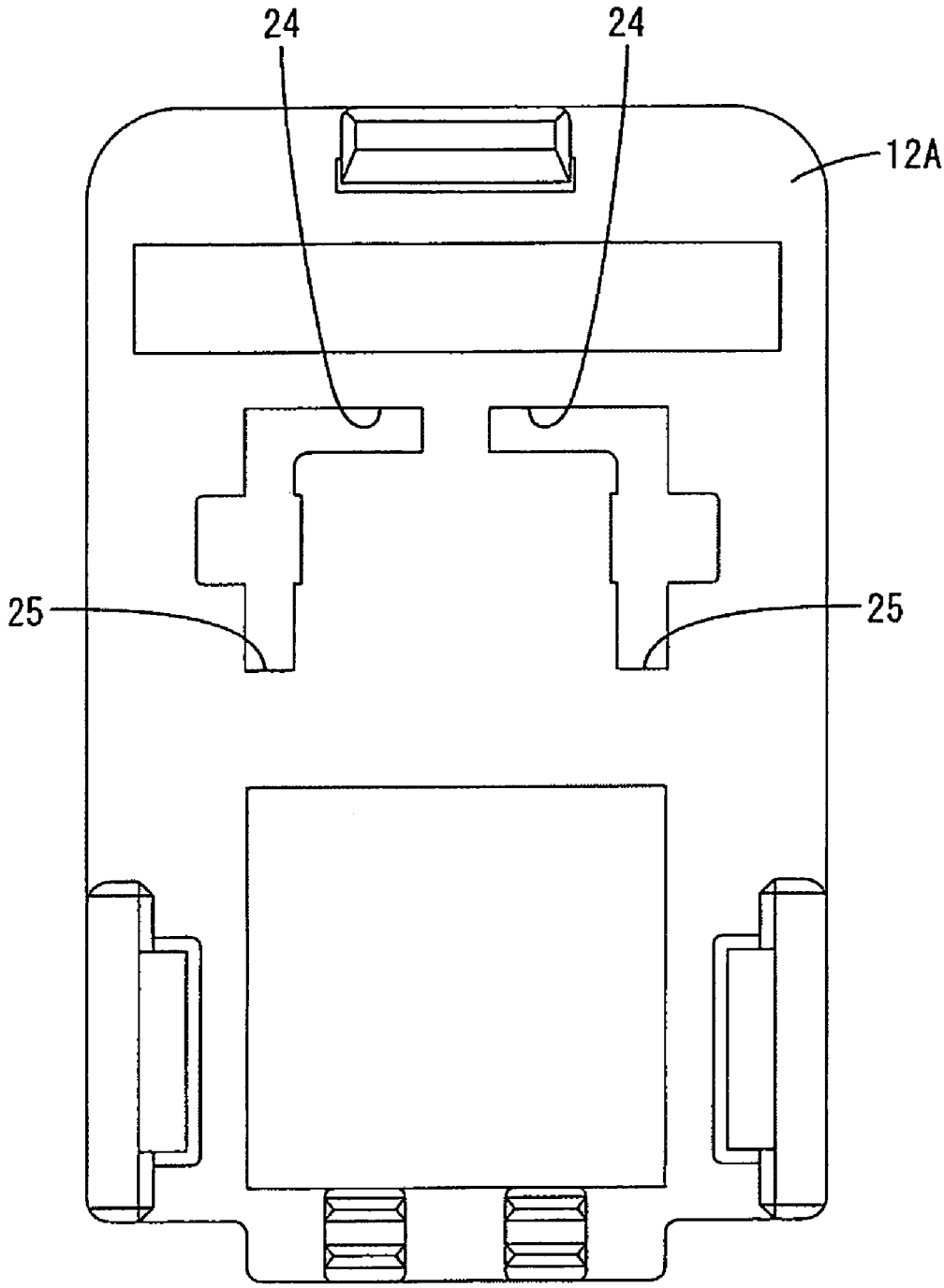
FIG. 10 is a rear view of a cover of the first housing.

Left and right guiding holes 24 penetrate the main body 11 of the first housing and the upper cover 12A in forward and backward directions. The guiding holes 24 have a wide transverse dimension and a smaller vertical dimension. The guiding holes 24 of the cover 12A communicate with the accommodating recess 17, and the lower inner peripheral edges of the guiding holes 24 of the main body 11 are substantially flush with and continuous with the upper surface of the connecting projection 13, as shown in FIG. 2. Communication holes 25 are formed in the main body 11 and the cover 12A and extend substantially perpendicularly down from ends of the respective guiding holes 24, as shown in FIG. 10. The communication holes 25 communicate with the accommodating recess 17 and with the deformation spaces 19 between the connecting projection 13 and the resilient pieces 18.

Figure 11:
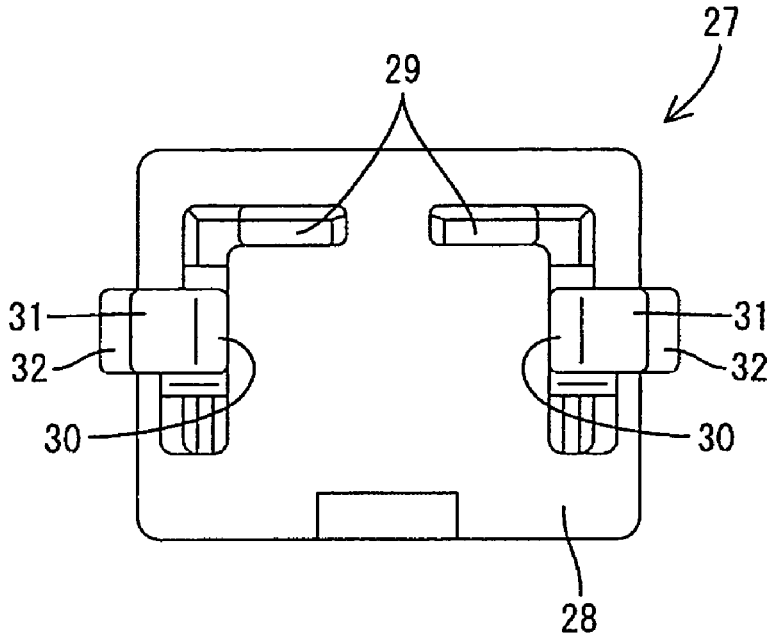
FIG. 11 is a front view of the releasing member.
Figure 12:
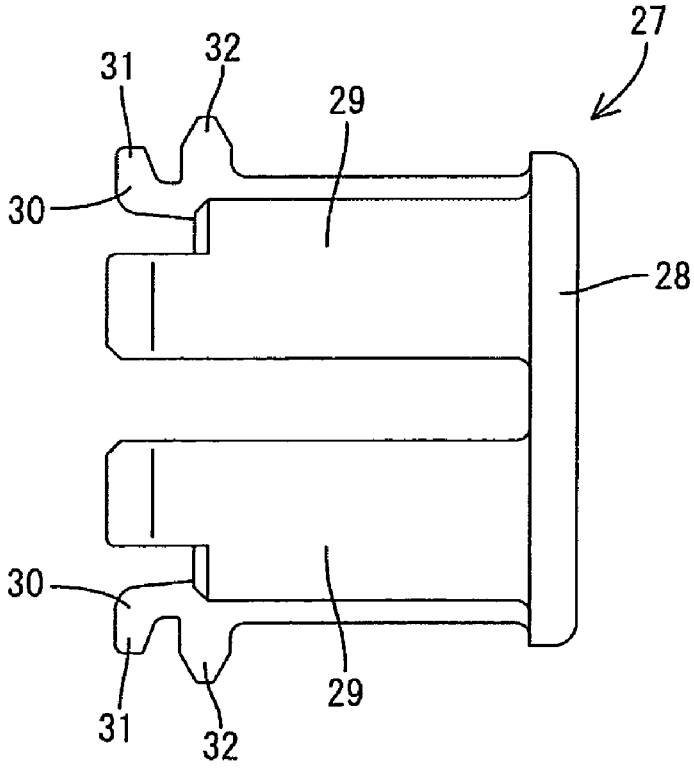
FIG. 12 is a plan view of the releasing member.
Figure 13:
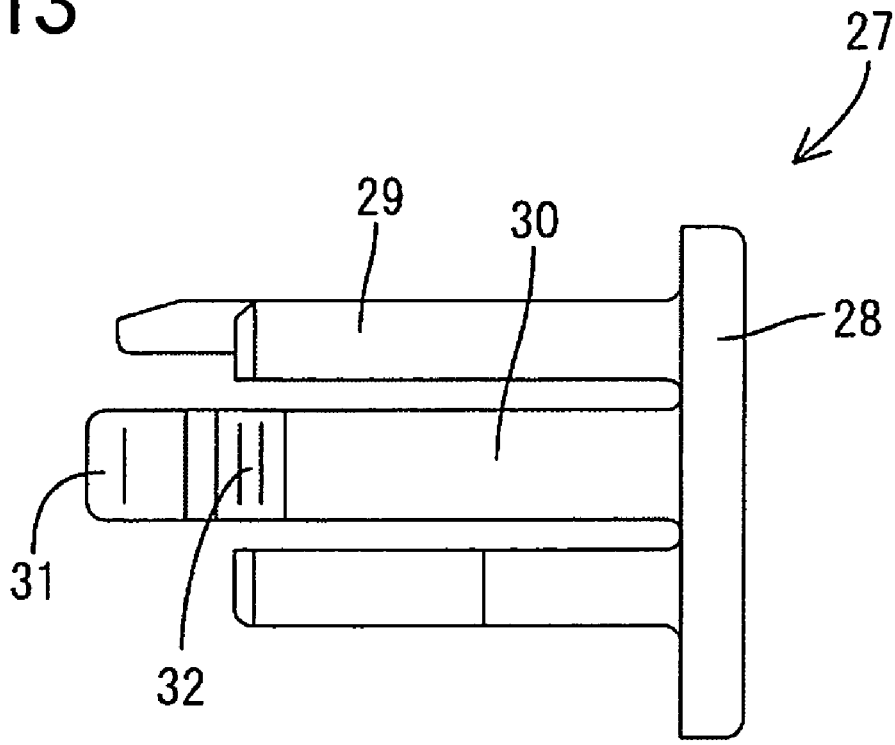
FIG. 13 is a side view of the releasing member.

The first housing 10 has a releasing member 27 that is made e.g. of a synthetic resin. The releasing member 27 includes a plate-shaped pressing portion 28 to be accommodated in the accommodating recess 17. Left and right substantially flat unlocking pieces 29 cantilever forward from upper-end positions of the pressing portion 28, and left and right locking pieces 30 cantilever forward from the left and right edges of the pressing portion 28, as shown in FIGS. 11–13. The unlocking pieces 29 are inserted into the guiding holes 24 from behind and are held in sliding contact with the inner surfaces of the guiding holes 24. Thus, the unlocking pieces are prevented from making relative vertical and transverse displacements. The locking pieces 30 are inserted into the communication holes 25 from behind. A first lock 31 projects laterally out from the outer surface of each locking piece 30. Further, a second lock 32 projects laterally out from the outer surface of each locking piece 30 at a position behind the first lock 31.

The releasing member 27 is movable forward and back relative to the first housing 10 along a moving direction MD that is substantially parallel with a connecting direction CD of the two housings 10, 40. A releasing position RP is defined at the forward end of the movable range of the releasing member 27 and a standby area is defined behind the releasing position RP. The releasing member 27 is held at a standby position SP in the standby area before the first housing 10 is connected with the second housing 40.

The second housing 40 is made e.g. of a synthetic resin and has a connecting recess 41 that opens in the front surface. Left and right long narrow male terminal fittings 42 project forward in the connecting recess 41. Likewise, a shorting terminal 43 is provided in the connecting recess 41 above the male terminal fittings 42 for shorting the male terminal fittings 42. The shorting terminal 43 is held resiliently in contact with both male terminal fittings 42 when the first and second housings 10, 40 are not connected or partly connected, thereby electrically connecting and shorting the male terminal fittings 42. Further, locking recesses 44 are formed in the left and right inner wall surfaces of the connecting recess 41.

The releasing member 27 initially is mounted in the first housing 10 at the standby position SP shown in FIG. 1. In this state, as shown in FIG. 2, the unlocking pieces 29 are inserted in the guiding holes 24. The guiding holes 24 prevent the releasing member 27 from displacing in transverse directions relative to the first housing 10 and hence in directions substantially normal to a moving direction MD of the releasing member 27 in the first housing 10. The moving direction MD of the releasing member 27 relative to the first housing 10 is substantially parallel to the connecting direction CD of the two housings 10, 40. Further, the first locks 31 engage the restricting portions 22 from behind to hold the releasing member 27 and to prevent a forward movement of the releasing member 27 relative to the first housing 10 along the moving direction MD. The releasing member 27 can be moved back relative to the first housing 10. However, the first and second locks 31 and 32 are in the windows 20 and the second locks 32 engage the rear edges of the windows 20 to prevent the releasing member 27 from coming backward out of the first housing 10. Further, the pressing portion 28 is outside the accommodating recess 17 and behind the cover 12A. At this time, a distance between the rear surface of the releasing member 27 (pressing portion 28) and the rear surface of the first housing 10 (cover 12A) is more than about 1.00 mm, preferably about 1.40 mm.

Figure 3:
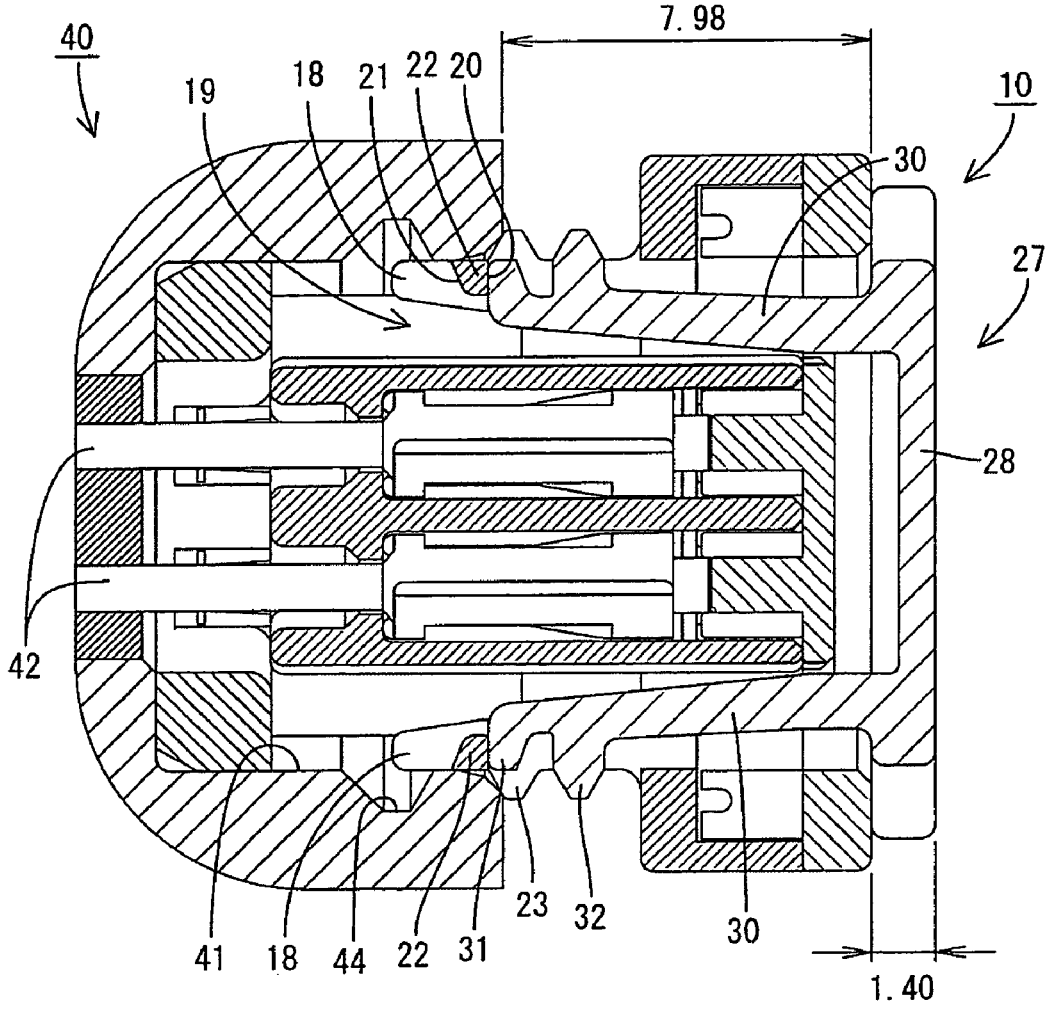
FIG. 3 is a horizontal section showing a state at the start of a connecting operation of the first and second housings.
Figure 4:
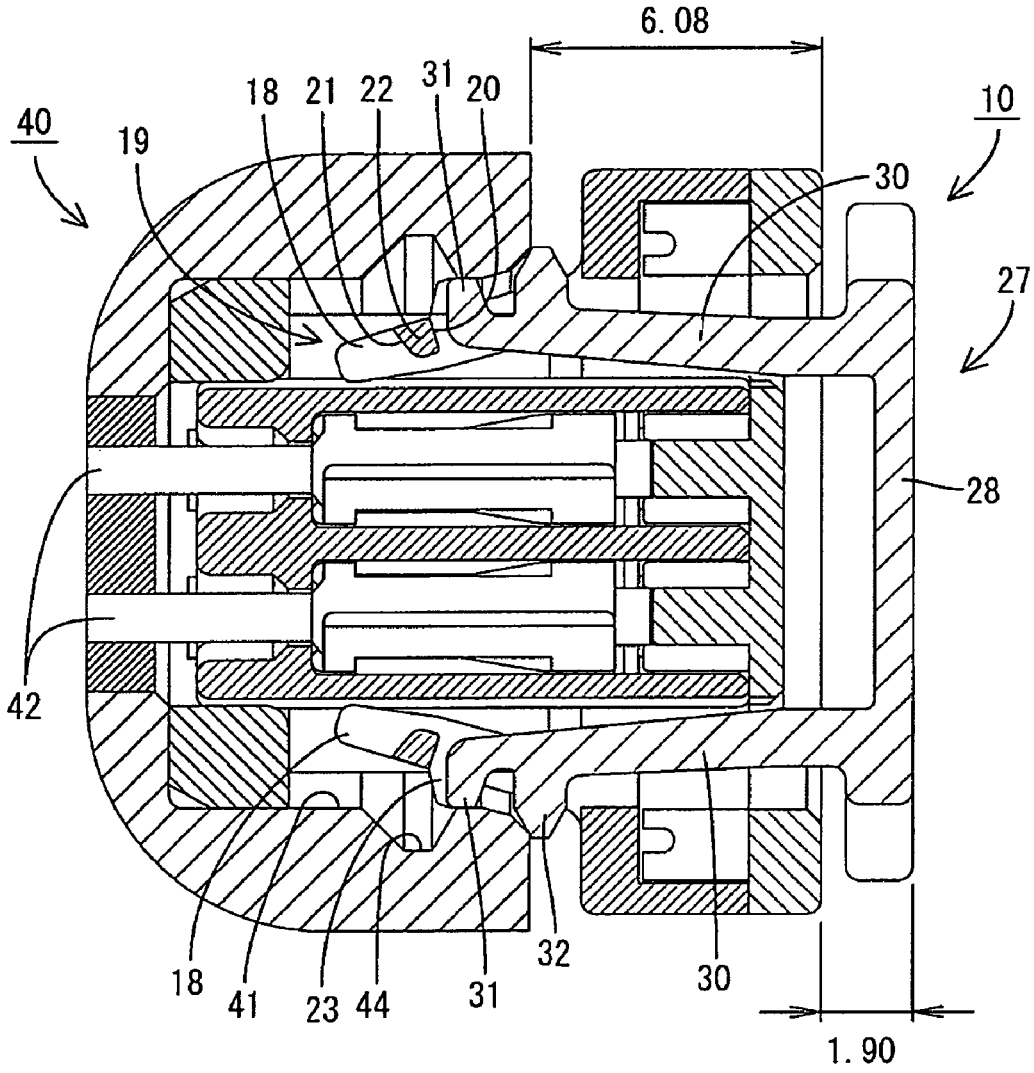
FIG. 4 is a horizontal section showing the process of connecting the first and second housings.

The first housing 10 is brought closer to the second housing 40 along the connecting direction CD to fit the connecting projection 13 lightly into the connecting recess 41. Thus, the disengaging portions 23 of the resilient pieces 18 contact the opening edges of the connecting recess 41, as shown in FIG. 3. At this time, a distance between the rear surface of the first housing 10 and the front surface of the second housing 40 e.g. is about 7.98 mm.

Fingers can be placed on the rear surface of the first housing 10 in this state to push the first housing 10 in the connecting direction CD towards the second housing 40. The connecting recess 41 interferes with the disengaging portions 23 and causes the resilient pieces 18 to deform inwardly into the deformation spaces 19 and in a direction intersecting the connecting direction CD, as shown in FIG.

4. The restricting portions 22 move laterally in and away from the first locks 31 as the resilient pieces 18 deform inward. Thus, the resilient pieces 18 and the locking pieces 30 disengage. However, the second locks 32 of the locking pieces 30 contact the opening edges of the connecting recess 41 to prevent the releasing member 27 from moving towards the second housing 40. Thus, the first housing 10 moves forward relative to the releasing member 27 as the first housing 10 approaches the second housing 40. In the state shown in FIG. 4, a distance between the rear surface of the first housing 10 and the front surface of the second housing 40 is shortened up to e.g. about 6.08 mm, whereas a distance between the rear surface of the releasing member 27 and the rear surface of the first housing 10 is extended e.g. to about 1.90 mm. At this time, the releasing member 27 is in the standby area.

Figure 5:
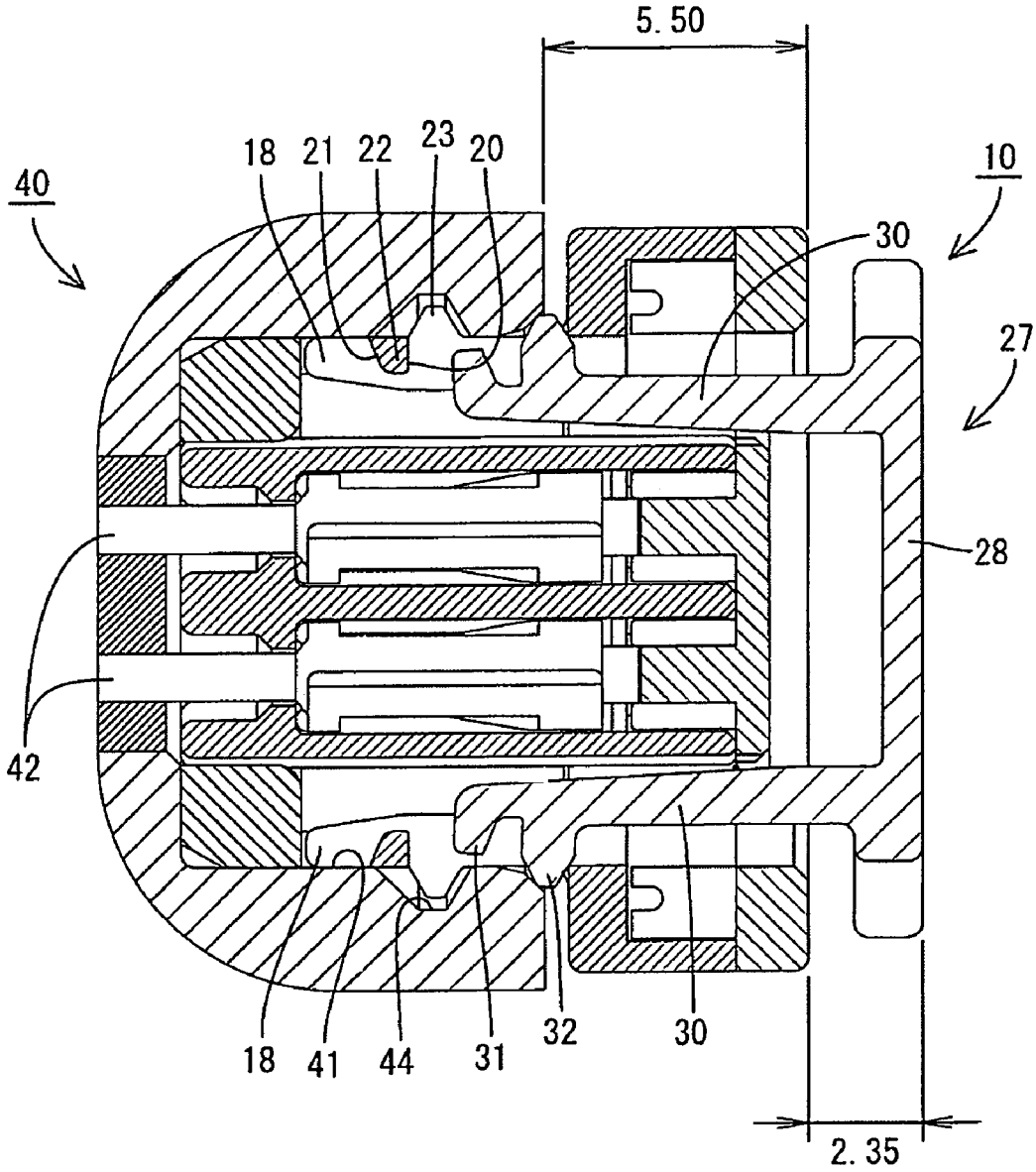
FIG. 5 is a horizontal section showing the process of connecting the first and second housings.

The first housing 10 can be pushed in this state so that the two housings 10, 40 reach a properly connected state, as shown in FIG. 5. As a result, the resilient pieces 18 are restored resiliently outward so that the disengaging portions 23 fit into the locking recesses 44. Additionally, the front ends of the resilient pieces 18 contact the back end surface of the connecting recess 41 to prevent any further approaching movements of the first and second housings 10 and 40. At this time, a distance between the rear surface of the first housing 10 and the front surface of the second housing 40 e.g. is about 5.5 mm, and a distance between the rear surface of the releasing member 27 and the rear surface of the first housing 10 is extended to e.g. about 2.35 mm.

Figure 6:
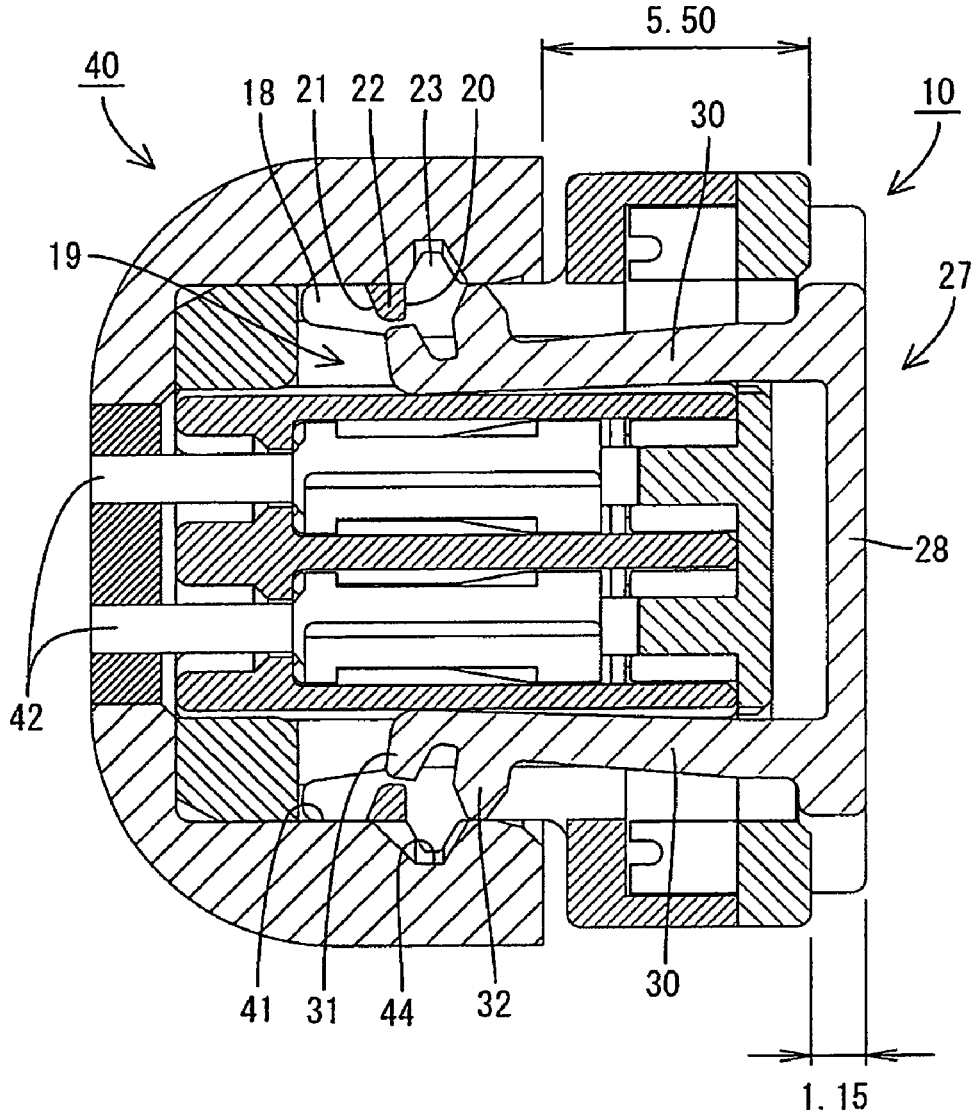
FIG. 6 is a horizontal section showing a state where the first and second housings are properly connected.

The rear surface of the releasing member 27 can be pushed in this state in the mounting direction MD to move the releasing member 27 forward relative to the first housing 10 and towards the second housing 40. In the meantime, the inner wall surfaces of the connecting recess 41 interfere with the second locks 32 and cause the locking pieces 30 to deform resiliently in towards the connecting projection 13, as shown in FIG. 6.

Figure 7:
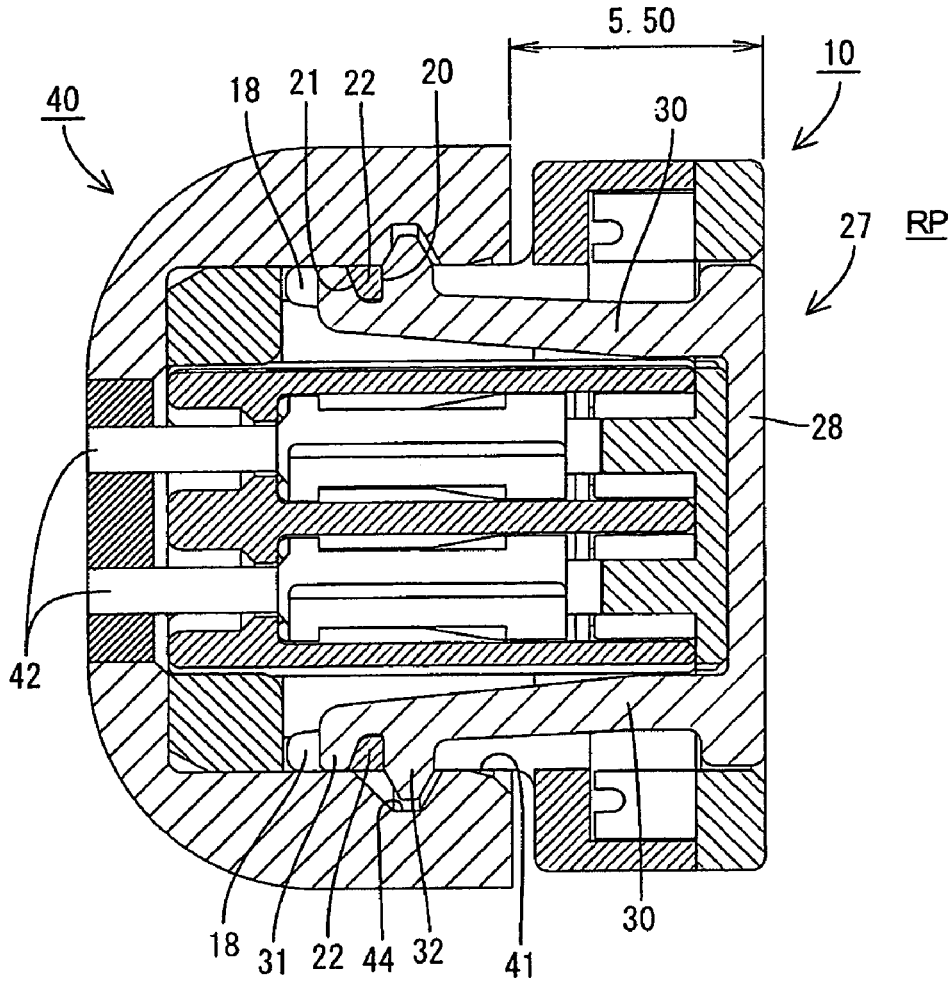
FIG. 7 is a horizontal section showing a state where the first and second housings are properly connected and a shorted state of male terminal fittings is released by a releasing member.
Figure 8:
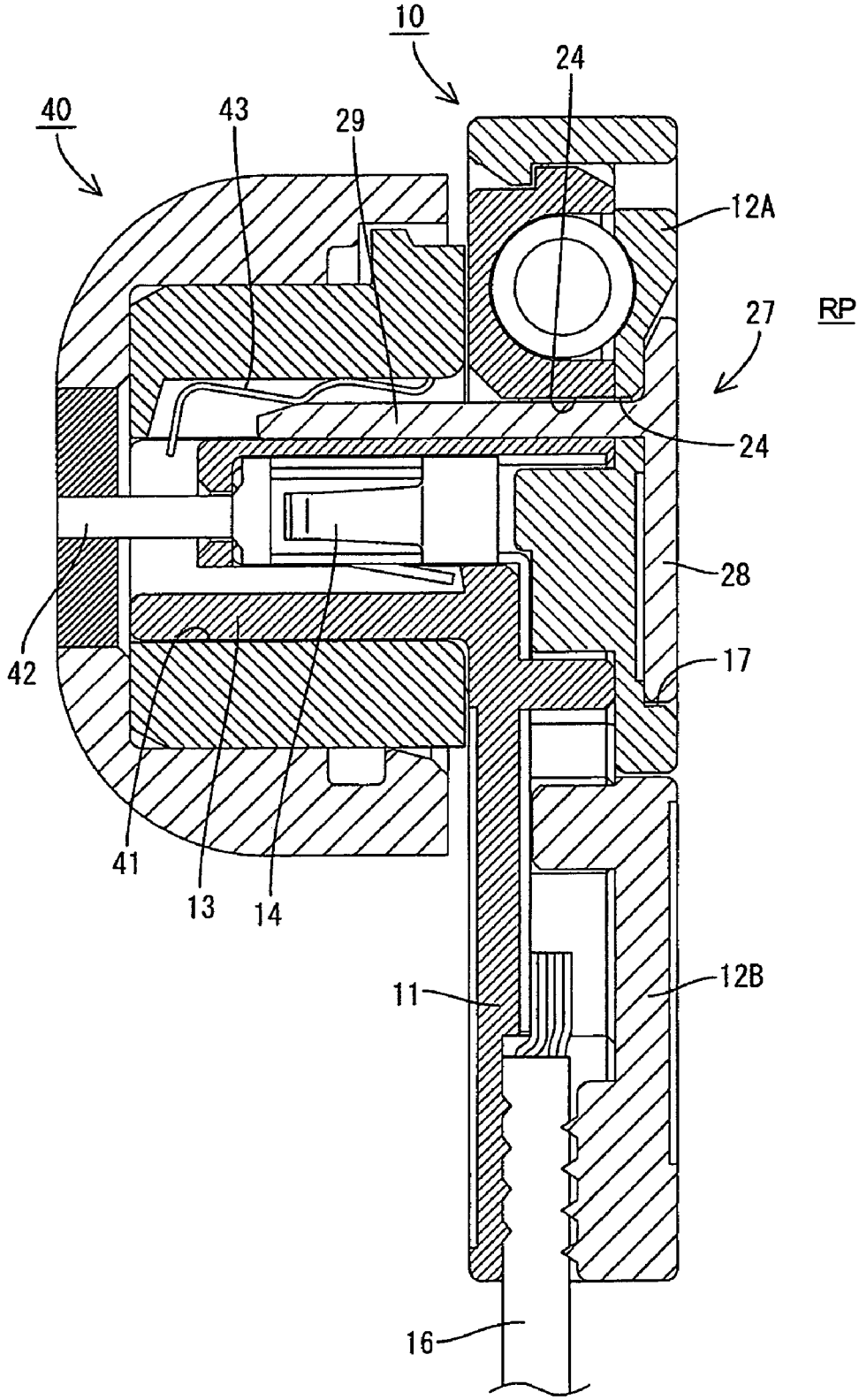
FIG. 8 is a vertical section showing the state where the first and second housings are properly connected and the shorted state of the male terminal fittings is released by the releasing member.
Figure 9:
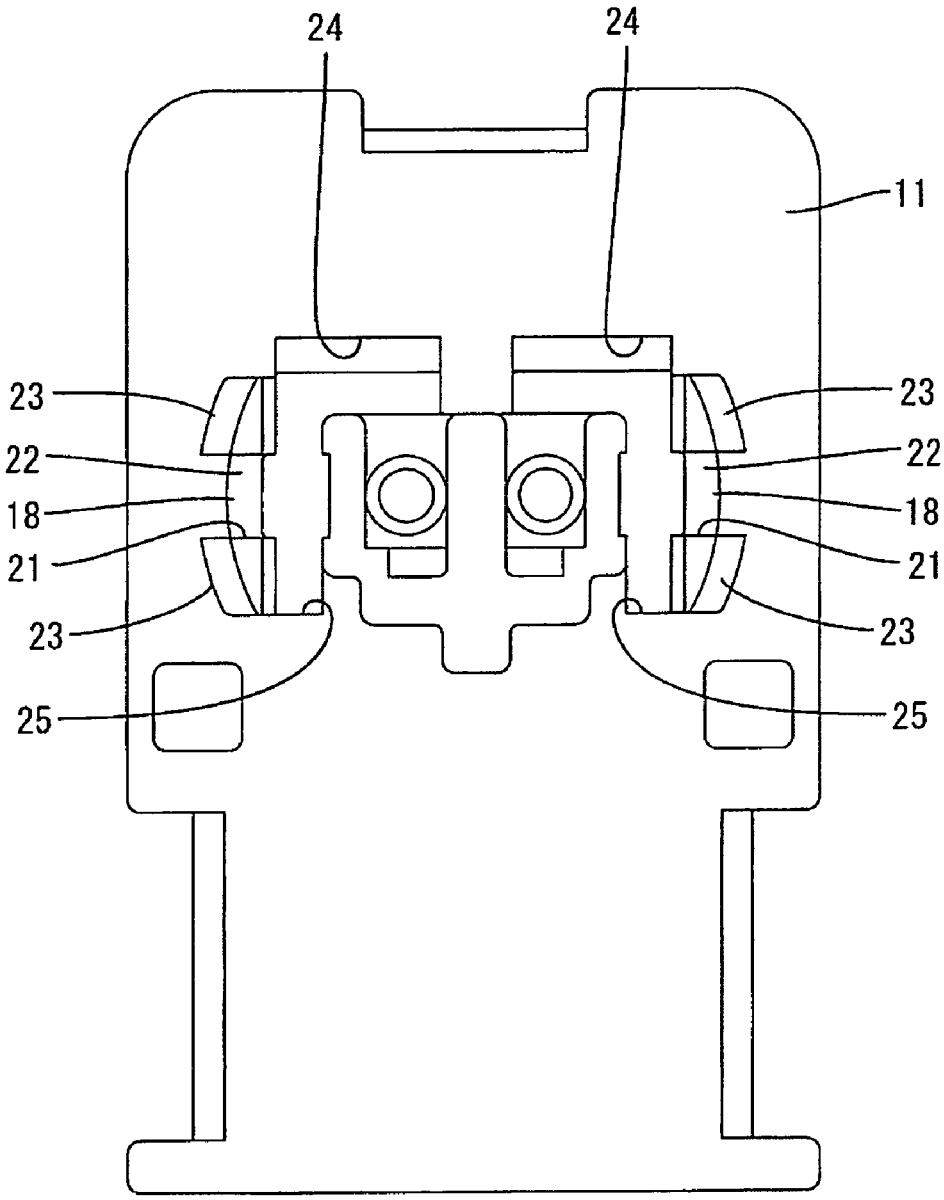
FIG. 9 is a front view of a main body of the first housing.

The locking pieces 30 are restored resiliently out, as shown in FIG. 7, when the releasing member 27 reaches the releasing position. Thus, the second locks 32 fit in the locking recesses 44, and the first and second locks 31, 32 engage the restricting portions 22 from the front and rear. Accordingly, the releasing member 27 cannot move forward or back relative to the first housing 10. Further, the pressing portion 28 of the releasing member 27 is accommodated in the accommodating recess 17 and the rear surface of the releasing member 27 becomes substantially flush with the rear surface of the first housing 10. The unlocking pieces 29 contact the shorting terminal 43 when the releasing member 27 reaches the releasing position RP to deform the shorting terminal 43 resiliently up and away from the male terminal fittings 42, as shown in FIG. 8. The resilient deformation of the shorting terminal 43 releases the shorted state of the left and right male terminal fittings 42.

As described above, the shorting terminal 43 is provided in the second housing 40 for shorting the male terminal fittings 42. The releasing member 27 is provided in the first housing 10 and is movable between the releasing position RP and the standby area behind the releasing position. The first housing 10 engages the releasing member 27 and holds the releasing member 27 in the standby area when the first and second housings 10, 40 are not yet connected. However, the releasing member 27 is moved to the releasing position RP to resiliently deform the shorting terminal 42 and to release the shorted state of the male terminal fittings 42 when the first and second housings 10, 40 are connected properly.

The first housing 10 is formed with guiding holes 24 that slidably receive the releasing member 27 in the movable range between the standby area and the releasing position RP. The releasing member 27 engages the second housing 40 in the process of connecting the first and second housings 10, 40 and is displaced back relative to the first housing 10. Additionally, the guiding holes 24 guide the releasing member 27 so that the releasing member 27 can be moved smoothly without being displaced or being forced.

The invention is not limited to the above described and illustrated embodiment, and various changes can be made without departing from the scope and spirit thereof. For example, the dimensions described above are intended to show only relative positions and relative movements of the housings 10, 40 and the releasing member. Actual dimensions can vary from these examples.

What is claimed is:

1. A connector for connection with a mating connector having a mating housing, mating terminals in the mating housing and a shorting terminal (43) for shorting the mating terminals (42), the connector comprising:

a housing having a front end for connection with the mating housing, at least one guiding hole extending through the housing in a front to rear direction, at least one resilient piece on the housing and a restricting portion formed on the resilient piece; and a releasing member having at least one unlocking piece slidably engaged in the guiding hole for guiding forward and rearward movement of the releasing member relative to the housing, the releasing member engaging the restricting portion when the resilient piece is in a first position for limiting forward movement of the releasing member relative to the housing, the resilient piece being deflected to a second position when the housing is connected with the mating housing for disengaging the releasing member from the restricting portion and permitting forward movement of the releasing member relative to the housing, whereby the forward movement of the releasing member enables the unlocking piece to deflect the shorting terminal away from the terminal fittings for releasing a shorted state of the terminal fittings when the housing is connected properly with the mating housing.

2. The connector of claim 1, wherein the releasing member is operable in a moving direction substantially parallel to a connecting direction of the housing with the mating housing.

3. The connector of claim 1, wherein unlocking pieces and the guiding holes are dimensioned for preventing the releasing member from being displaced in directions at an angle to a moving direction of the releasing member relative to the housing.

4. The connector of claim 1, further comprising at least one first lock and at least one second lock formed on the releasing member and being engageable with at least one window of the housing so that the resilient member can be moved backward relative to the housing without coming backward out of the housing.

5. The connector of claim 1, further comprising a locking piece on the releasing member for engaging the restricting portion of the resilient piece when the housing is not yet connected with the mating housing for holding the releasing member in a standby area.

6. The connector of claim 5, wherein the resilient piece is disposed to be engaged by the mating housing in the process of connecting the housing with the mating housing and deformed resiliently to the second position for releasing an interlocked state of the resilient piece and the locking piece.

7. The connector of claim 6, wherein the resilient piece and the locking piece are resiliently deformable in directions at an angle to interlocking directions of the resilient piece and the locking piece.

8. The connector of claim 1, wherein the guiding hole is substantially flat in cross-section.

9. The connector of claim 1, wherein a rear surface of the releasing member is substantially flush with a rear surface of the housing when the releasing member is moved forward to a releasing position.

10. A connector assembly, comprising:

a first housing having opposite front and rear ends, first terminal fittings mounted in the first housing, at least one resilient piece projecting forward on the first housing and a restricting portion formed on the resilient piece;

a second housing having a connecting recess for receiving the first housing, second terminal fittings projecting into the connecting recess and being connectable with the first terminal fittings when the first housing is inserted into the connecting recess, a resiliently deflectable shorting terminal mounted in the second housing for shorting the second terminal fittings; and a releasing member mounted movably in the first housing and having at least one forwardly projecting unlocking piece, the restricting portion of the first housing engaging the releasing member and preventing forward movement of the releasing member when the first housing is not connected with the second housing, the restricting portion being disengaged from the releasing member when the first housing is connected with the second housing for permitting movement of the releasing member into a position where the unlocking piece deforms the shorting terminal away from the second terminal fittings.

11. The connector assembly of claim 10, wherein the releasing member is operable in a moving direction substantially parallel to a connecting direction of the first housing with the second housing.

12. The connector assembly of claim 11, wherein unlocking pieces and the guiding holes are dimensioned for preventing the releasing member from being displaced in directions at an angle to a moving direction of the releasing member relative to the first housing.

13. The connector assembly of claim 12, wherein the guiding hole is substantially flat in cross-section.

14. The connector assembly of claim 10, further comprising a locking piece on the releasing member for engaging the restricting portion of the resilient piece when the first housing is not yet connected with the second housing for holding the releasing member in a standby area.

15. The connector assembly of claim 14, further comprising at least one first lock and at least one second lock formed on the locking piece of the releasing member and being engageable with at least one window of the housing so that the resilient member can be moved backward relative to the first housing without coming backward out of the first housing.

16. A connector assembly, comprising:

a mating housing having a front end and a connecting recess extending into the front end, a locking recess formed in the connecting recess, terminal fittings projecting into the connecting recess and a resiliently deflectable shorting terminal mounted in the second housing for shorting the second terminal fittings;

a first housing having a front end configured for insertion into the connecting recess, at least one resilient piece projecting forward on the first housing, the resilient piece being configured to engage the front end of the mating housing during insertion of the front end of the first housing into the connecting recess and to be deflected inwardly, the resilient piece returning resiliently to engage in the locking recess when the first housing is connected properly with the mating housing, and a restricting portion formed on the resilient piece; and a releasing member mounted movably in the first housing and having at least one forwardly projecting unlocking piece, the restricting portion of the first housing engaging the releasing member and preventing forward movement of the releasing member when the first housing is not connected with the second housing, the restricting portion being disengaged from the releasing member when the first housing is being fit in the connecting recess of the mating housing for permitting movement of the releasing member into a position where the unlocking piece deforms the shorting terminal away from the second terminal fittings.

17. The connector assembly of claim 16, wherein the first housing has at least one guiding hole extending through the housing in a front to rear direction, the unlocking piece being guided slidably through the guiding hole.

18. The connector assembly of claim 17, wherein unlocking pieces and the guiding holes are dimensioned for preventing the releasing member from being displaced in directions at an angle to a moving direction of the releasing member relative to the first housing.

19. The connector assembly of claim 18, wherein the guiding hole is substantially flat in cross-section.

* * * * *